United States Patent [19]

Hotvet et al.

[11] Patent Number: 4,827,525

[45] Date of Patent: May 2, 1989

[54] ATTACHMENT DEVICE FOR A PROBE MICROPHONE

[75] Inventors: David A. Hotvet, Savage; Ernest L. Woodfill, Columbia Heights, both of Minn.; Rolf C. Rising, Kungsbacka, Sweden

[73] Assignee: Minnesota Mining and Manufacturing Company, St. Paul, Minn.

[21] Appl. No.: 192,354

[22] Filed: May 10, 1988

Related U.S. Application Data

[63] Continuation-in-part of Ser. No. 181,222, Apr. 13, 1988.

[51] Int. Cl.[4] ..... H04R 29/00

[52] U.S. Cl. ..... 381/60; 73/585

[58] Field of Search ..... 381/68.6, 169, 683, 381/72, 60, 93; 73/585

[56] References Cited

U.S. PATENT DOCUMENTS

| | | | |
|---|---|---|---|
| 3,882,848 | 5/1975 | Klar et al. | 73/585 |
| 4,029,083 | 6/1977 | Baylor | 73/585 |
| 4,109,116 | 8/1978 | Victoreen | 381/93 |
| 4,412,096 | 10/1983 | Edgerton et al. | 381/60 |
| 4,425,481 | 1/1984 | Mangold et al. | 381/68 |
| 4,548,082 | 10/1985 | Engebretsen et al. | 73/585 |
| 4,628,907 | 12/1986 | Epley | 381/68.3 |
| 4,688,582 | 8/1987 | Heller et al. | 73/585 |

OTHER PUBLICATIONS

Poul B. Madsen, "Insertion Gain Optimization", Hearing Instruments, vol. 37, No. 1, pp. 28–32 (1986).

David A. Preves and Roy F. Sullivan, "Sound Field Equalization For Real Ear Measurements With Probe Microphones", Hearing Instruments, vol. 38, No. 1, pp. 28–32 (1987).

Harvey Dillon and Narelle Murray, "Accuracy of Twelve Methods For Estimating the Real Ear Gain of Hearing Aids", *Ear and Hearing*, vol. 8, No. 1, Williams & Wilkins Co. (1987).

*Primary Examiner*—Forester W. Isen

*Attorney, Agent, or Firm*—Donald M. Sell; Walter N. Kirn; William D. Bauer

[57] ABSTRACT

An attachment device for a probe microphone adapted to be utilized in conjunction with the external ear canal of a person having an ear lobe. A housing is adapted to contain the probe microphone and secures the housing in a fixed relationship with respect to the ear lobe of the person. A probe tube is coupled to the housing and is adapted to be coupled to the probe microphone and adapted to be inserted into the external ear canal of the person. A holding mechanism is coupled to the housing and receives the probe tube and slideably secures the probe tube in a repositionably fixed relationship to the housing. In this manner the housing may be secured and positioned with respect to the ear lobe and the probe tube may be slid through the holding mechanism and positioned reliably in the external ear canal. A marker may be attached to the probe tube to reliably mark a particular location along the probe tube for further reference by a user of the attachment device so that the user may mark a particular location along the probe tube with reference to an extrinsic landmark.

15 Claims, 5 Drawing Sheets

ATTACHMENT DEVICE FOR A PROBE MICROPHONE

RELATED APPLICATIONS

This application is a continuation-in-part of U.S. patent application Ser. No. 181,222 Rolf Christer Rising, Magnetic Attachment Apparatus for Ear-Level Microphone, filed Apr. 13, 1988.

BACKGROUND OF THE INVENTION

The present invention relates to probe microphones for measuring sound levels in or near the external ear canal and more particularly to attachment devices for probe microphones.

When a person is being fitted for a new hearing aid, such as the hearing aid disclosed in U.S. Pat. No. 4,425,481, Mangold et al, it is often necessary to measure sound levels (commonly called the "sound pressure level," or SPL) in that person's ear canal in order to properly select parameter values for use in the hearing aid. Furthermore, in order to perform such sound level measurements, it is generally necessary to insert a probe tube into the person's ear canal (i.e., the external auditory meatus) for conducting sound from the measuring point to a microphone. The microphone detects the sound levels and generates an electrical signal which is transmitted to a system for measuring the detected sound levels. The receiving system uses the measured sound levels to calculate parameter values for use in a hearing aid. The receiving system may also be utilized to confirm the proper output of a hearing aid after the parameter values have been calculated and the hearing aid has been set to those parameters.

While measuring the sound pressure level in a person's ear canal, it is important to control the position of the probe tube which conducts sound from the measuring point in the ear canal to a microphone. Variations in this position directly affect the measured sound level, which will affect the correctness of the measurements and the hearing aid gain parameters calculated using those measurements.

Another aspect of measuring sound pressure levels in the ear canal is the use of a reference microphone. Reference microphones are used in a variety of standard measurement methods, including the methods known as the "comparison method", the "pressure method" and the "modified pressure method". The comparison method requires that the test microphone and the reference microphone, employed to measure the free field sound pressure, be placed simultaneously at two acoustically equivalent points in the sound field, i.e., in each of the two ear canals. The pressure method uses a pressure-calibrated reference microphone at a point close to the entry of the ear canal to control the input sound pressure level produced by a sound source, e.g., a loudspeaker, to eliminate diffraction effects. Modified pressure methods differ from the pressure method only in that the reference microphone is placed near the earlobe rather than at the precise location of the opening of the ear canal. These methods are described by Paul B. Madsen, "Insertion gain optimization," Hearing Instruments, vol. 37, no. 1, pp 28–32 (1986); David A. Preves and Roy F. Sullivan, "Sound field equalization for real ear measurements with probe microphones," Hearing Instruments, vol. 38, no. 1, pp 28–32 (1987); and Harvey Dillon and Narelle Murray, "Accuracy of Twelve Methods for Estimating the Real Ear Gain of Hearing Aids," Ear and Hearing, vol. 8, no. 1, Williams & Wilkins Co. (1987). The aforementioned references are hereby incorporated by reference in their entirety.

The prior art includes a number of systems for holding a probe tube in a fixed position in a person's ear canal. These systems generally use hooks over the pinna (i.e., the external ear), and/or headbands encircling all or part of the head. Furthermore, these systems are generally cumbersome, and are too limited in flexibility to be easily used with all patients, or require elaborate mechanical arrangements (e.g., gimbals) in order to change the position of the probe tube.

SUMMARY OF THE INVENTION

The present invention provides an attachment device for holding a probe microphone in a fixed spatial relationship with respect to the external ear canal of a person. Prior art devices are cumbersome and too limited in flexibility or are not reliable in their positioning characteristics.

The present invention enables the reliable measurement of sound pressure levels and other "real ear" measurements while retaining an easily usable, flexible attachment system which is not cumbersome.

In order to make reliable "real ear" measurements it is not only necessary to hold the case, or housing, of the probe microphone in a relatively fixed relationship with respect to the external ear canal, but also it is extremely important to hold, or position, the probe tube for the probe microphone in a fixed relationship with respect to the external ear canal and to know and reliably reproduce that fixed relationship.

The present invention provides an attachment device for a probe microphone adapted to be utilized in conjunction with the external ear canal of a person having an ear lobe. A housing is adapted to contain the probe microphone and secures the housing in a fixed relationship with respect to the ear lobe of the person. A probe tube is coupled to the housing and is adapted to be coupled to the probe microphone and adapted to be inserted into the external ear canal of the person. A holding mechanism is coupled to the housing and receives the probe tube and slideably secures the probe tube in a repositionably fixed relationship to the housing. In this manner the housing may be secured and positioned with respect to the ear lobe and the probe tube may be slid through the holding mechanism and positioned reliably in the external ear canal.

In a preferred embodiment the probe tube is releasably coupled to the microphone in the housing. In a preferred embodiment the holding mechanism swivels with respect to the housing. In a preferred embodiment the holding mechanism allows full three hundred sixty degree freedom of movement with respect to the housing. In a preferred embodiment the probe tube is sized to allow for the probe tube to be friction fit within the holding mechanism. In one embodiment the holding mechanism is an eyelet receiving the probe tube. In another embodiment the holding mechanism is a split collar receiving the probe tube. In a preferred embodiment the attachment device has a marker attached to the probe tube for reliably marking a particular location along the probe tube for further reference by a user of the attachment device whereby the user may mark a particular location along the probe tube with reference to an extrinsic landmark. In a preferred embodiment the marker is slideably attached to the probe tube. In a preferred embodiment the marker is a first O-ring slideably friction fit over the probe tube. In a preferred embodiment the attachment device further has a second O-ring slideably friction fit over the probe tube and positioned next to the holding mechanism to help secure the probe tube reliably with respect to the holding mechanism.

The present invention also provides an attachment device for a probe microphone adapted to be utilized in conjunction with the external ear canal of a person having an ear lobe. A housing is adapted to contain the probe microphone and securing the housing in a fixed relationship with respect to the ear lobe of the person. A probe tube is coupled to the housing and is adapted to be coupled to the probe microphone, positioned with respect to the housing and adapted to be inserted into the external ear canal of the person. A marker is attached to the probe tube and reliably marks a particular location along the probe tube for further reference by a user of the attachment device so that the user may mark a particular location along the probe tube with reference to an extrinsic landmark.

It is preferred that the probe tube be releasably coupled to the microphone in the housing. It is also preferred that the marker be slideably attached to the probe tube. In a preferred embodiment the marker is an O-ring slideably friction fit over the probe tube.

BRIEF DESCRIPTION OF THE DRAWINGS

The foregoing advantages, construction and operation of the present invention will become more readily apparent from the following description and accompanying drawings in which.

DESCRIPTION OF THE PREFERRED EMBODIMENTS

Figure 1:
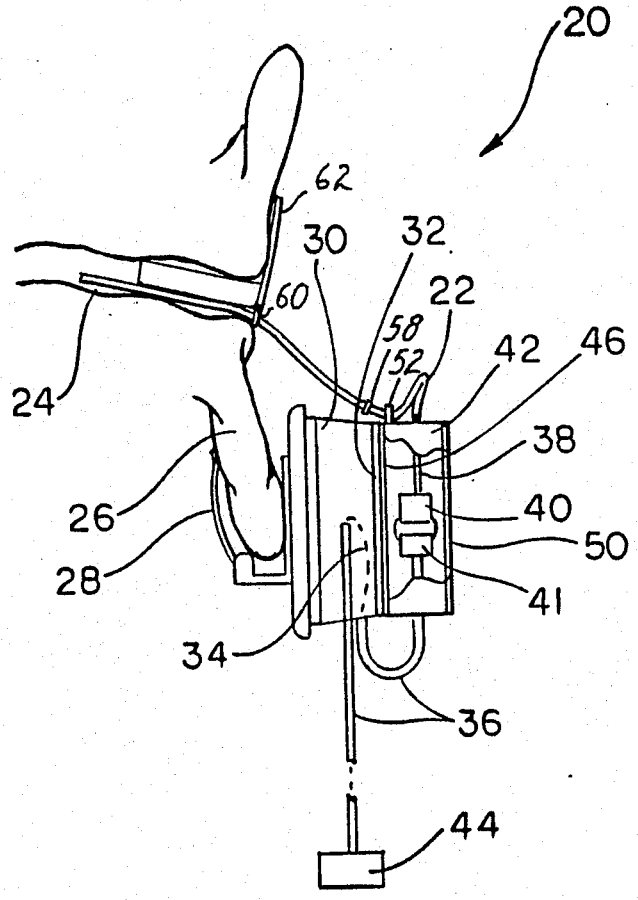
FIG. 1 schematically shows an attachment device for holding a probe tube in an external ear canal, and a reference microphone in close proximity to the external ear canal.
Figure 2:
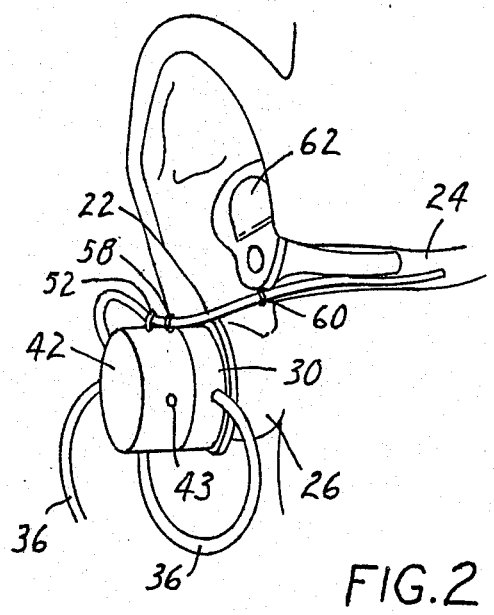
FIG. 2 is a perspective view of the attachment device of the present invention.
Figure 3:
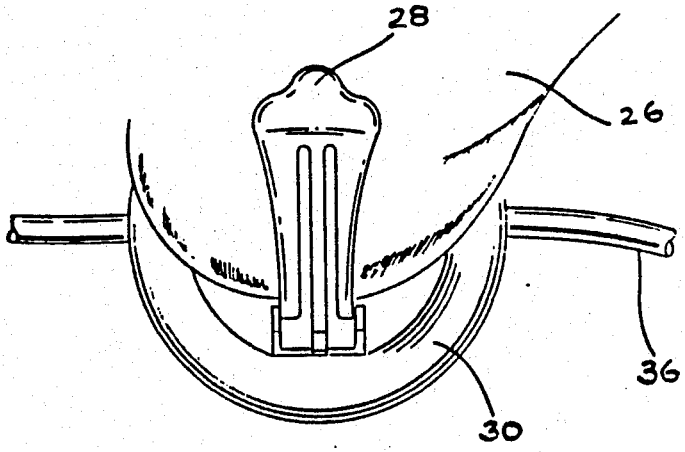
FIGS. 3, 4 and 5 show a member for attaching the device of FIG. 1 to a person's outer ear.

Referring to FIGS. 1 and 2, there is shown an arrangement or device 20 for holding a flexible probe tube 22 in an ear canal 24. Typically the probe tube is constructed of plastic, such as silicone. As shown in FIG. 3, the device 20 is attached to a person's ear lobe 26 by an ear clip 28. In the preferred embodiment, the ear clip 28 is similar in shape and function to the ear clips used in women's jewelry for unpierced ears.

Figure 5:
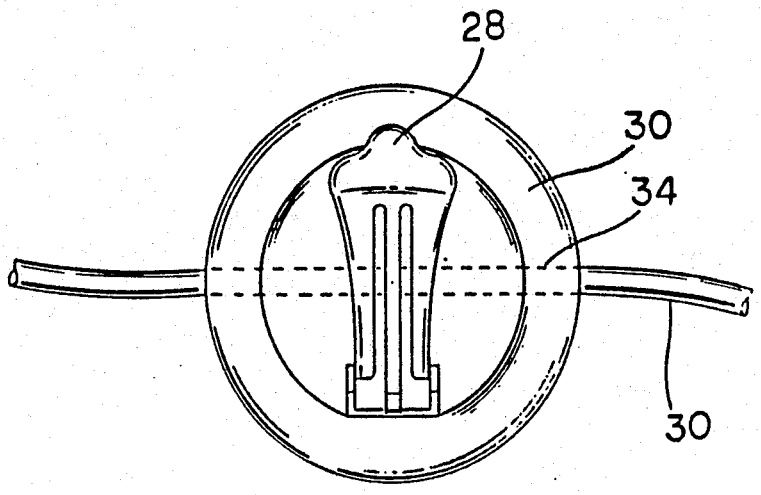
Figure 4:
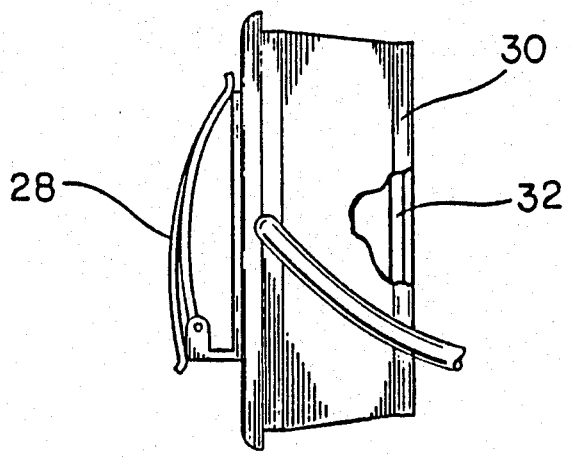

Referring to FIG. 4, the clip 28 is affixed to a carrier 30 for a magnet 32. In a preferred embodiment the carrier 30 is cylindrically shaped and is constructed from a plastic material although other shapes and materials are also contemplated. In a preferred embodiment the magnet 32 is disk shaped although other shapes are also contemplated. As shown in FIGS. 1–3, the magnet 32 faces away from the ear lobe 26. In addition, as shown in FIGS. 1 and 5, the plastic carrier 30 contains an aperture 34 for holding a wire 36.

Figure 6:
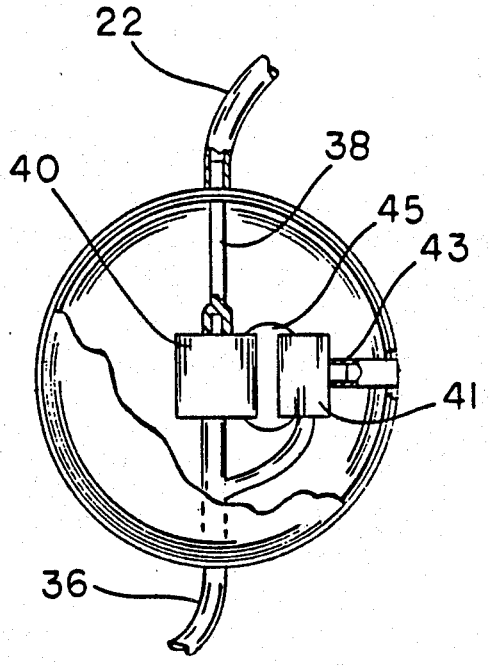
FIG. 6 shows a second member of the device, which holds a microphone.

Referring now to FIGS. 1, 2 and 6, the probe tube 22 is coupled by a tube 38, which may be a hollow steel tube, to a microphone 40 housed in a microphone case 42, which may be cylindrically shaped. Microphone 40 is sometimes referred to as the probe microphone. The fixed placement of the probe microphone 40 and tube 38 in the case 42 anchors the flexible probe tube 22.

The purpose of the probe microphone 40 is to detect and amplify the acoustical sounds signals (i.e., sound pressure levels) conducted by the probe tube 22 to the probe microphone 40, and to generate an electronic signal corresponding to the sound signals conducted by the probe tube 22. The resulting electronic signals are transmitted by wire 36 to a system 44 for measuring the detected sound levels and generating a set of corresponding hearing aid parameters. System 44 is well known in the art.

A second microphone 41, sometimes called the reference microphone, is also housed in the microphone case 42. As shown in FIG. 2, the microphone case 42 has an aperture 43 so that the reference microphone can detect sound pressure levels outside the microphone case 42, in the vicinity of the opening of the ear canal. The tube 38 for the first microphone and the aperture 43 for the reference microphone are oriented so that the aperture 43 faces forward, toward the opening of the ear canal, when the tub 38 is oriented for holding the probe tube 22 inside the ear canal 24.

The reference microphone 41 is acoustically isolated from the probe tube microphone by rubber gaskets 45, preferably made from silicone rubber. The purpose of the reference microphone 41 is to detect the sound pressure level generated by a controlled loudspeaker in the vicinity of the opening of the ear canal 24, which is also close to the location of a hearing aid microphone when a hearing aid is being used. The sound pressure level detected by the reference microphone is then used to control the sound pressures generated by the loudspeaker, using conventional feedback control techniques.

In the preferred embodiment, wire 36 actually comprises a set of wires: two shielded cables, each having a shield serving as the common or signal ground voltage source and a wire inside the shield for transmitting electronic signals from the corresponding microphone 40 or 41, plus one wire for conveying power (e.g., at 10 volts) from the measurement system 44 to both of the microphones 40 and 41.

It should be noted that the wire 36 is held by the carrier 30 to isolate the probe tube 22 from movements of the wire 36. In other words, the wire 36 is held by the plastic carrier so that small movements of the wire 36 will not change the position of the microphone case 42 relative to the carrier 30 or the ear canal 24.

The microphone case 42 is constructed so that it holds a magnetic member 46 (in this case, a steel plate) which is magnetically attracted to the magnet 32 in the carrier 30. As will be described in more detail below, the magnetic attraction of the two magnetic members 32 and 46 enables the user to both secure and easily adjust the position of the probe tube 22 in the ear canal 24.

Microphone case 42 also holds a second magnetic member 50 (i.e., another steel disk) on the end of the case 42 which is opposite the other magnetic member 46 in the case. To use the second magnetic member, the entire magnetic case 42 is disengaged from the carrier 30, and the magnetic case is flipped or rotated so that the second magnetic member 50 faces or is brought into contact with the magnet 32. Depending on whether the device 20 is being used with the left or the right ear, it will be easier to properly position the probe tube 22 in an ear canal 24 when one or the other of these two magnetic members 46 or 50 is coupled to the magnet 32. Providing two magnetic members 46 and 50 also enables the aperture 43 for the reference microphone to face forward, toward the opening of the ear canal, regardless of which ear the device 20 is being used with. It should also be noted that the wire 36 can be rotated inside the aperture 34 in the carrier 30 to facilitate proper positioning of the probe tube 22.

In order that reliable "real ear" measurements can be taken with respect to the external ear canal 24, it is important that the probe tube 22 be reliably placed in the same position, or a known position, with respect to the external ear canal 24 when the sound level is measured with an open (unoccluded) external ear canal 24 and with the ear mold (for a hearing aid or other auditory prosthesis) in place. Important features of the present invention allow the probe tube 22 to positioned properly within the external ear canal 24 and then reliably positions the probe tube 22 in a known position, preferably the same position, with respect thereto. Such reliable positioning or marking is also important during any calibration of the probe microphone 40 which may be required.

Figure 7:
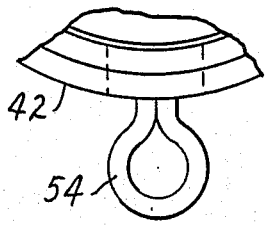
FIGS. 7 and 8 illustrate preferred embodiments of the holding mechanism feature of the present invention.
Figure 8:
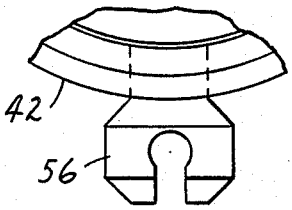

As shown in FIGS. 1 and 2, a holding mechanism 52 is attached to microphone case 42. Holding mechanism 52 holds the probe tube 22 in a fixed relationship with respect to the microphone case 42 between the probe tube's 22 attachment to the microphone case 42 and the probe tube's 22 entering the external ear canal 24. Holding mechanism 52 is designed to reliably and flexibly hold probe tube 22. It is preferred that probe tube 22 slip into or snap into holding mechanism 52. It is preferred that holding mechanism 52 swivel, or pivot, preferably a full three hundred sixty degrees, with respect to microphone case 42 to allow for flexibility in positioning. In a preferred embodiment, probe tube 22 is friction fit within holding mechanism 52 for secure, reliable holding. Holding mechanism 52 may be an eyelet 54 as illustrated in FIG. 7 or may be a split collar 56 as illustrated in FIG. 8. Thus, probe tube 22 may slide in, as with eyelet 54, or may snap in, as with split collar 56.

A small diameter, rubber O-ring 58 may be placed on probe tube 22 to aid in the positioning of probe tube 22 with respect to the external ear canal 24. A second small diameter, rubber O-ring 60 may be placed on the probe tube 22 to aid in placement of the probe tube 22 with respect to the external ear canal 24 during "real ear" measurements. O-ring 60 operates as a marker to help to fitter place the probe tube 22 properly. Both O-ring 58 and O-ring 60 are preferably molded from rubber and, in a preferred embodiment, have an internal diameter of 0.032 inch (8 millimeters) and a outside diameter of 0.086 inch (22 millimeters).

O-ring 60 may be used as a marker for "real ear" measurements with an aid 62. O-ring 60 may be slid along probe tube 22 and placed in a fixed relationship with respect to the aid 62. The aid 62 may then be placed into the external ear canal 24 and the probe tube 22 placed along side using the O-ring 60 as a marker to reposition the probe tube 22 with respect to the aid 62 as it was before. Once the real ear measures are taken with the aid 62 in place in the external ear canal 24, the aid 62 may be removed and the probe tube 22 may be reliably placed in the external ear canal 24 again using O-ring 60 as a marker, this time with respect a known and remembered feature of the ear canal 24, the ear lobe 26, the pinna or other physical characteristic of the patient.

Figure 9:
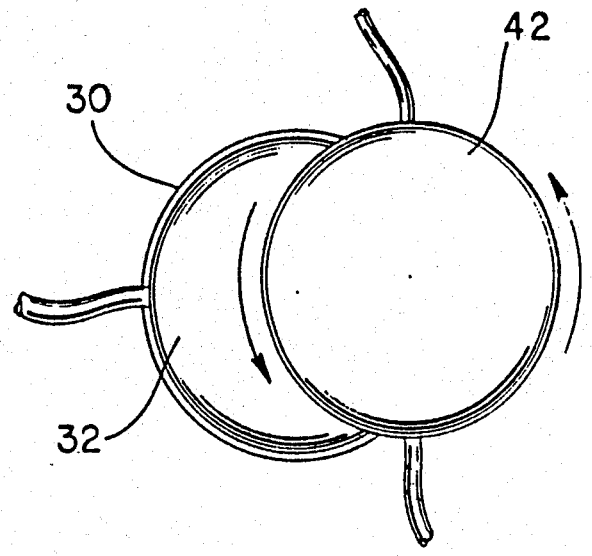
FIGS. 9 and 10 show how the apparatus can be used to adjust the position of a probe tube by angular and lateral adjustments of the position of the microphone holding member.
Figure 10:
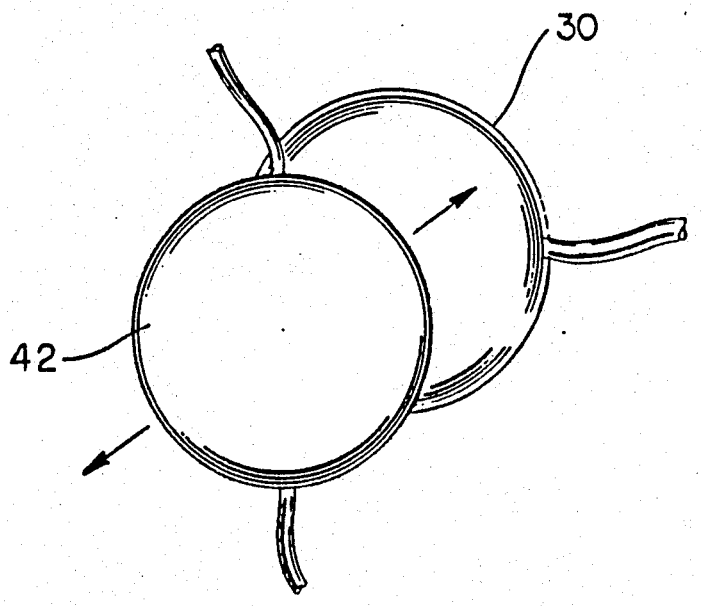

Referring to FIGS. 2, 9 and 10, the position of the probe tube 22 in an ear canal 24 is secured by clipping the carrier 30 to the subject's ear lobe, placing one of the magnetic members of the microphone case 42 against the magnet 32, placing the probe tube 22 in the ear canal 24, and then positioning the microphone case 42 relative to the subject's ear canal. The microphone case 42 is held in its selected position by the magnetic attraction of the magnetic members in the carrier 30 and the microphone case 42.

Referring to FIGS. 9 and 10, the flat surfaces of the magnetic members in the carrier 30 and the microphone case 42 enable the positions of the carrier 30 and the case 42 to be adjusted both angularly (as shown in FIG. 9) and laterally or translationally (as shown in FIG. 10).

Thus, it can be seen that there has been shown and described a novel attachment device for a probe microphone. It is to be recognized and understood, however, that various changes, modifications and substitutions in the form and the details of the present invention may be made by those skilled in the art without departing from the scope of the invention as defined by the following claims.

What is claimed is:

1. An attachment device for a probe microphone adapted to be utilized in conjunction with the external ear canal of a person having an ear lobe, comprising:

housing means adapted to contain said probe microphone and securing said housing means in a fixed relationship with respect to the ear lobe of said person;

a probe tube coupled to said housing means and adapted to be coupled to said probe microphone and adapted to be inserted into said external ear canal of said person; and holding means coupled to said housing means receiving said probe tube and slideably securing said probe tube in a repositionably fixed relationship to said housing means;

whereby said housing may by secured and positioned with respect to said ear lobe, said probe tube may be slid through said holding means and positioned reliably in said external ear canal.

2. An attachment device for a probe microphone as in claim 1 wherein said probe tube is releasably coupled to said microphone in said housing means.

3. An attachment device for a probe microphone as in claim 1 wherein said holding means swivels with respect to said housing means.

4. An attachment device for a probe microphone as in claim 3 wherein said holding means allows full three hundred sixty degree freedom of movement with respect to said housing means.

5. An attachment device for a probe microphone as in claim 3 with said holding means and said probe tube being sized to allow for said probe tube to be friction fit within said holding means.

6. An attachment device for a probe microphone as in claim 1 wherein said holding means comprises an eyelet receiving said probe tube.

7. An attachment device for a probe microphone as in claim 1 wherein said holding means comprises a split collar receiving said probe tube.

8. An attachment device for a probe microphone as in claim 1 which further comprises marker means attached to said probe tube for reliably marking a particular location along said probe tube for further reference by a user of said attachment device whereby said user may mark a particular location along said probe tube with reference to an extrinsic landmark.

9. An attachment device for a probe microphone as in claim 8 wherein said marker means is slideably attached to said probe tube.

10. An attachment device for a probe microphone as in claim 8 wherein said marker means comprises a first O-ring slideably friction fit over said probe tube.

11. An attachment device for a probe microphone as in claim 10 which further comprises a second O-ring slideably friction fit over said probe tube and positioned next to said holding means to help secure said probe tube reliably with respect to said holding means.

12. An attachment device for a probe microphone adapted to be utilized in conjunction with the external ear canal of a person having an ear lobe, comprising:

housing means adapted to contain said probe microphone and securing said housing means in a fixed relationship with respect to said ear lobe of said person;

a probe tube coupled to said housing means and adapted to be coupled to said probe microphone, positioned with respect to said housing means and adapted to be inserted into said external ear canal of said person; and marker means attached to said probe tube for reliably marking a particular location along said probe tube for further reference by a user of said attachment device whereby said user may mark a particular location along said probe tube with reference to an extrinsic landmark.

13. An attachment device for a probe microphone as in claim 12 wherein said probe tube is releasably coupled to said microphone in said housing means.

14. An attachment device for a probe microphone as in claim 12 wherein said marker means is slideably attached to said probe tube.

15. An attachment device for a probe microphone as in claim 14 wherein said marker means comprises a first O-ring slideably friction fit over said probe tube.

* * * * *